US007014334B2

(12) United States Patent
Liaw et al.

(10) Patent No.: US 7,014,334 B2
(45) Date of Patent: Mar. 21, 2006

(54) COUPLING MECHANISM OF FLASHLIGHT COMPONENTS

(75) Inventors: Suh Jang Liaw, Taichung (TW); Dih Shuen Liaw, Taichung (TW)

(73) Assignee: Shih Sanyo Enterprise Co., LTD, Taichung (TW)

( * ) Notice: Subject to any disclaimer, the term of this patent is extended or adjusted under 35 U.S.C. 154(b) by 48 days.

(21) Appl. No.: 10/870,868

(22) Filed: Jun. 16, 2004

(65) Prior Publication Data

US 2005/0281022 A1 Dec. 22, 2005

(51) Int. Cl.
*F21L 4/00* (2006.01)

(52) U.S. Cl. ..... 362/194; 362/202; 362/205; 362/208

(58) Field of Classification Search ..... 362/194, 362/202, 205, 203, 204, 208, 171
See application file for complete search history.

(56) References Cited

U.S. PATENT DOCUMENTS 6,045,236 A * 4/2000 Cheng et al. ..... 362/188
6,296,367 B1 * 10/2001 Parsons et al. ..... 362/183
6,808,290 B1 * 10/2004 Lee ..... 362/202
6,837,599 B1 * 1/2005 Liaw et al. ..... 362/473

* cited by examiner

*Primary Examiner*—John Anthony Ward
*Assistant Examiner*—Jacob Y. Choi
(74) *Attorney, Agent, or Firm*—Pro-Techtor Int'l Services

(57) ABSTRACT

A flashlight having its components securely coupled together is provided. Mounting an illumination member in an engagement member, attaching a connecting assembly to an illumination assembly by bending latches downwardly for allowing a ridge to engage with slots, and attaching the coupled connecting assembly and the illumination assembly to a battery compartment by engaging a flat with a bottom of a first wall to electrically couple the illumination assembly to the battery compartment, inserting a pin insert into a gap between second walls for positioning, engaging keys with transverse portions of L-shaped grooves, and rotating the illumination assembly about the battery compartment until the keys enter into vertical portions of the grooves will secure the above components together.

4 Claims, 6 Drawing Sheets

COUPLING MECHANISM OF FLASHLIGHT COMPONENTS

FIELD OF THE INVENTION

The present invention relates to flashlights and more particularly to a flashlight having its components coupled together by means of an improved mechanism.

BACKGROUND OF THE INVENTION

Most conventional flashlights are comprised of two or more sections coupled together. However, such coupling is subject to looseness after a short time of use. This can compromise the electrical connection of the flashlight. Thus, the need for improvement still exists.

SUMMARY OF THE INVENTION

It is an object of the present invention to provide a flashlight comprising a disk-shaped connecting assembly comprising an upper flat having positive and negative contacts provided thereon, the flat extended rearwards, a lower pin extended rearwards and parallel with the flat, and a peripheral engagement member including an annular ridge and a plurality of equally spaced latches along the ridge; an illumination assembly comprising a forward sleevelike engagement member including a plurality of equally spaced axial, internal ribs each having a rear slot, a plurality of equally spaced indentations along a rear edge of the engagement member, and a plurality of L-shaped grooves; and an intermediate illumination member; and a hollow, cylindrical battery compartment comprising an axial, internal first wall having a circuit board mounted therein, two parallel axial, internal second walls, and a plurality of equally spaced keys along a forward edge thereof; whereby mounting the illumination member in the engagement member, attaching the connecting assembly to the illumination assembly by bending the latches downwardly for allowing the ridge to engage with the slots, and attaching the coupled connecting assembly and the illumination assembly to the battery compartment by engaging the flat with a bottom of the first wall to electrically couple the illumination assembly to the battery compartment, inserting the pin insert into a gap between the second walls for positioning, engaging the keys with transverse portions of the grooves, and rotating the illumination assembly with respect to the battery compartment until the keys enter into vertical portions of the grooves will secure the illumination assembly, the connecting assembly, and the battery compartment together. Advantageously, the flashlight of the present invention is not subject to looseness even after a long time of use. This ensures a reliable electrical connection of the flashlight.

The above and other objects, features and advantages of the present invention will become apparent from the following detailed description taken with the accompanying drawings.

DETAILED DESCRIPTION OF THE PREFERRED EMBODIMENTS

Figure 1:
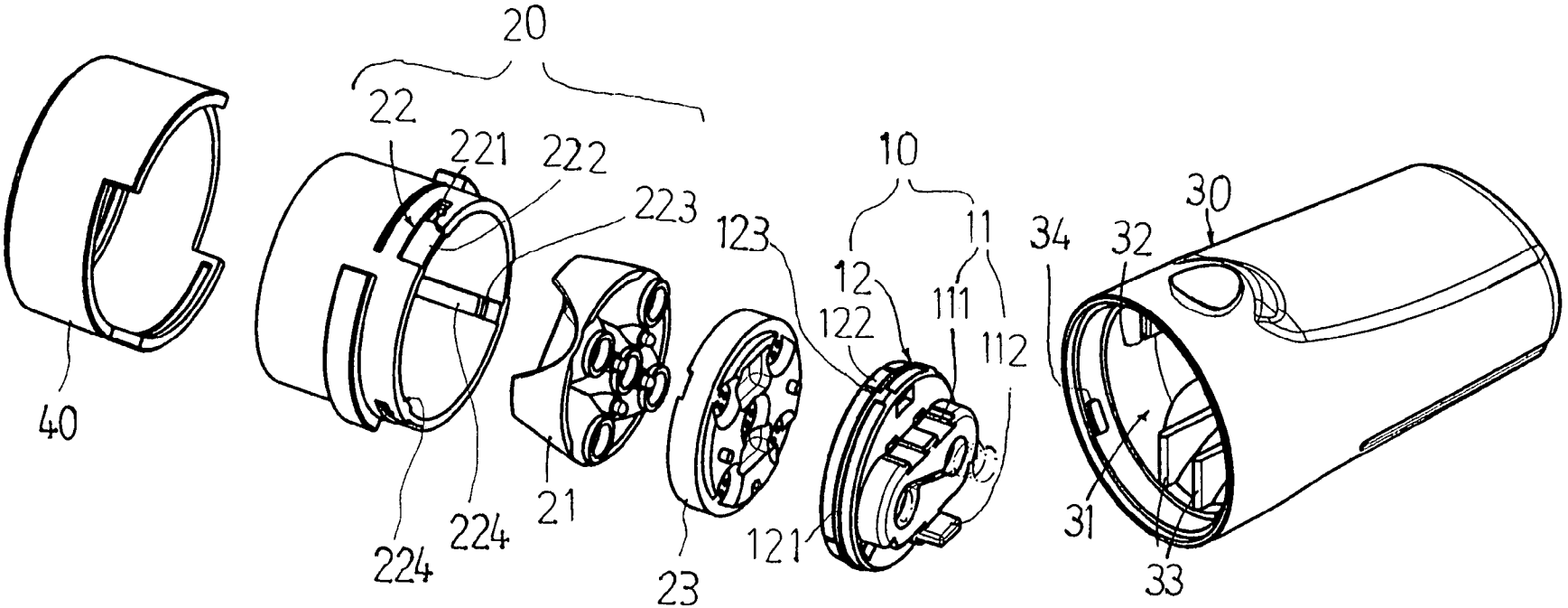
FIG. 1 is an exploded view of a preferred embodiment of flashlight according to the invention.

Referring to FIGS. 1 to 6, a flashlight constructed in accordance with the invention comprises a forward hollow barrel 40, a rear battery compartment 30, a connecting assembly 10, and an illumination assembly 20 all are coaxially disposed. A mechanism for coupling them together will be described in detailed below.

The disk-shaped connecting assembly 10 comprises a rear guide 11 including an upper flat 111 having positive and negative contacts provided thereon, and a lower pin 112 in which both the flat 111 and the pin 112 are extended rearwards and parallel each other, and a peripheral engagement member 12 including an annular ridge 121 and three equally spaced groups along the ridge 121, each group comprised of two gaps 123 and a latch 122 integrally formed with the ridge 121 and confined by the gaps 123.

The illumination assembly 20 comprises a forward sleevelike engagement member 22 including three equally spaced axial ribs 224 on an inner surface, each rib 224 having a slot 223 proximate a rear opening, three equally spaced indentations 222 along a rear edge, and three recesses 221 each with the indentation 222 forming an L-shaped groove; an intermediate illumination member 21 mounted with one or more LEDs (light-emitting diodes); and a rear holder 23.

The hollow, cylindrical battery compartment 30 has a closed rear end and comprises an inner shell 31, an axial first wall 32 provided on the inner shell 31 with a circuit board mounted therein, two parallel axial second walls 33 provided on the inner shell 31, and three equally spaced keys 34 along a forward edge of the inner shell 31.

Figure 2:
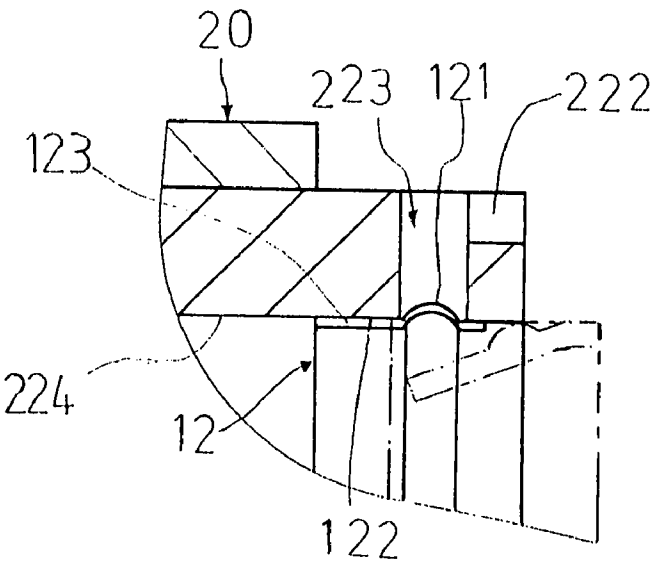
FIG. 2 is a sectional view showing the coupling of the connecting assembly and the illumination assembly.
Figure 1A:
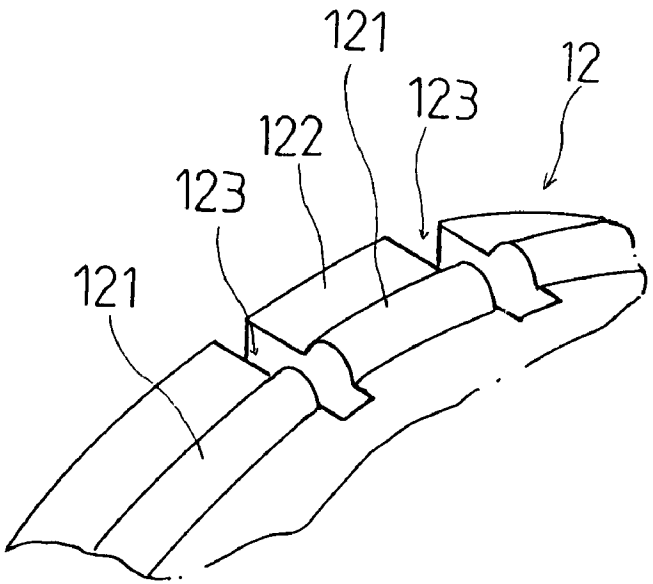
FIG. 1A is a greatly enlarged view of a portion of connecting assembly.
Figure 3:
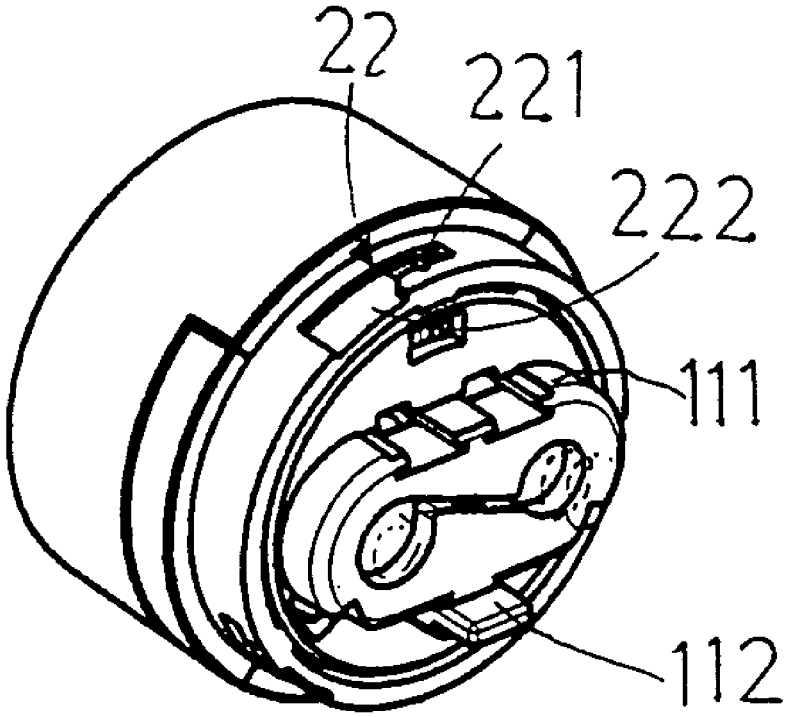
FIG. 3 is a perspective view of the coupled connecting assembly and illumination assembly.
Figure 4B:
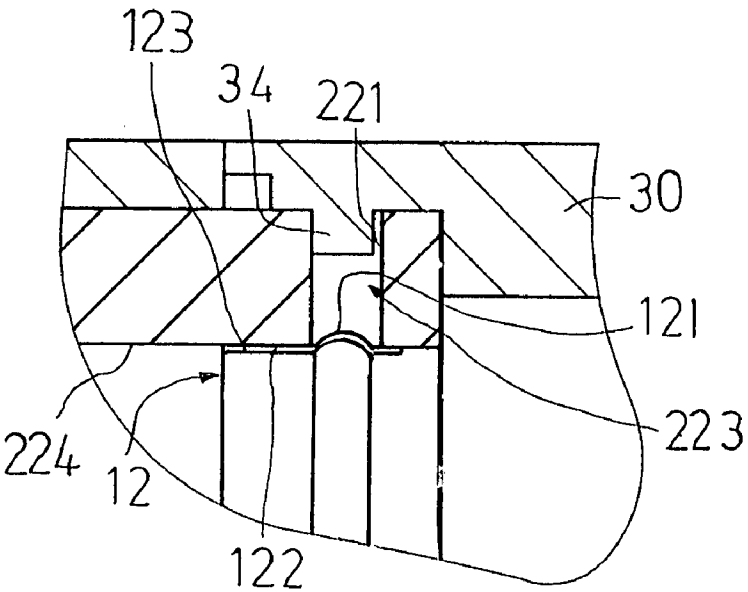
FIGS. 4A and 4B are sectional views showing the assembly of the coupled connecting assembly and illumination assembly with the battery compartment.
Figure 4A:
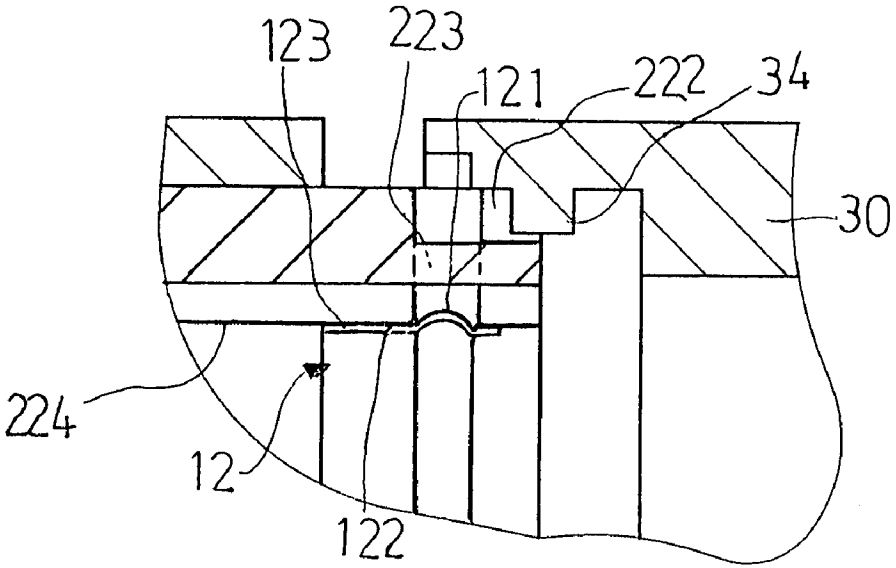
Figure 5B:
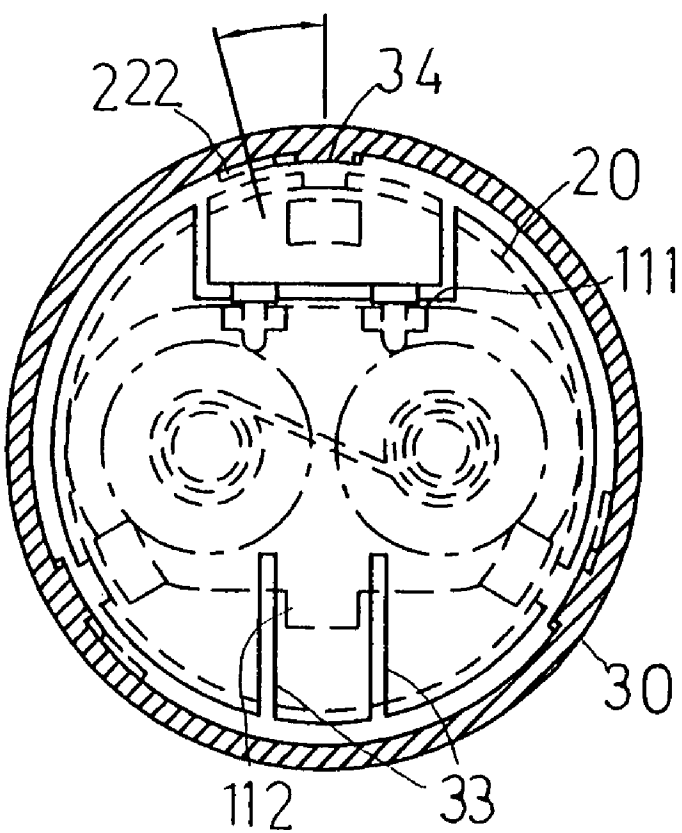
FIGS. 5A and 5B are front schematic views of FIGS. 4A and 4B respectively.
Figure 5A:
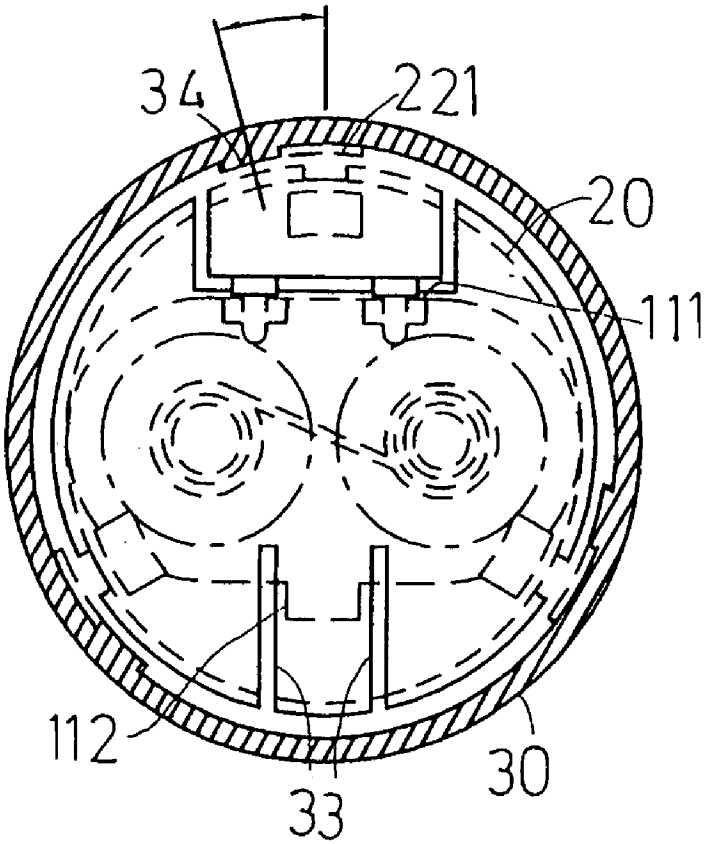
Figure 6:
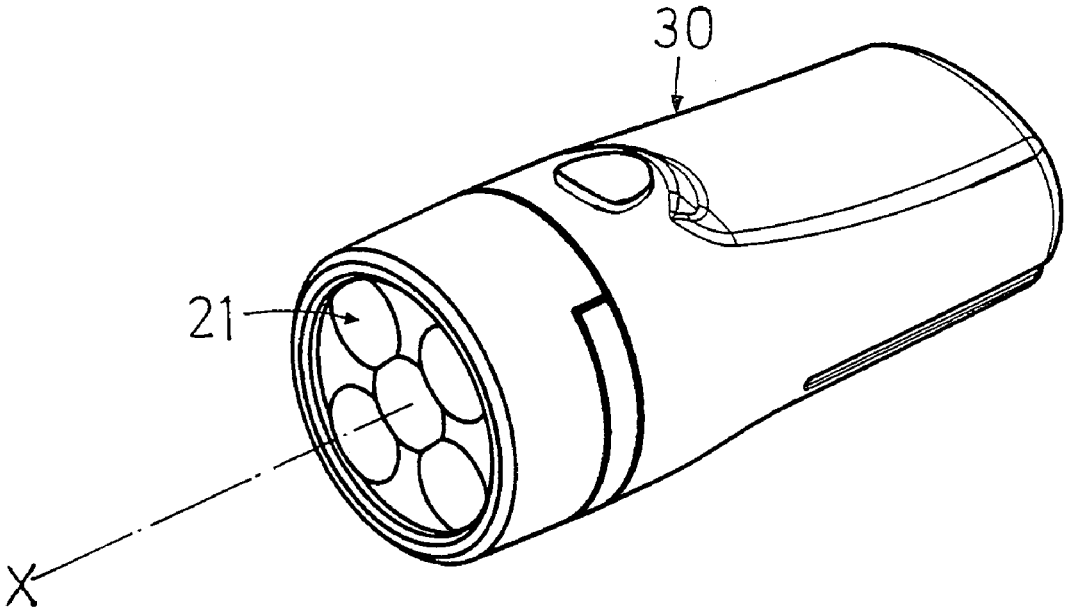
FIG. 6 is a perspective view of assembled flashlight shown in FIG. 1.

An assembly of the above components will be described in detailed below by referring to FIGS. 1A, 2, and 3. First, mount the illumination member 21 and the holder 23 in the engagement member 22. Next, attach the connecting assembly 10 to the illumination assembly 20 in which the latches 122 are bent downwardly prior to allowing the ridge 121 to matingly engage with the slots 223. Next, attach the coupled connecting assembly 10 and illumination assembly 20 to the battery compartment 30 by referring to FIGS. 4A, 4B, 5A, and 5B. In the process, the flat 111 will engage with a bottom of the axial first wall 32 (i.e., electrically coupled both the illumination assembly 20 and the battery compartment 30 together) and the pin 112 will insert into a gap between the axial second walls 33 for positioning. Also, the keys 34 will engage with the recesses 221. Next, rotate the illumination assembly 20 with respect to the battery compartment 30 until the keys 34 enter into the indentations 222 for securing the illumination assembly 20' to the battery compartment 30. Finally, put the hollow barrel 40 on the illumination assembly 20 to finish the assembly (see FIG. 6).

Advantageously, the flashlight of the invention is not subject to looseness even after a long time of use. This ensures a reliable electrical connection of the flashlight.

While the invention herein disclosed has been described by means of specific embodiments, numerous modifications and variations could be made thereto by those skilled in the art without departing from the scope and spirit of the invention set forth in the claims.

What is claimed is:

1. A flashlight comprising:

a disk-shaped connecting assembly comprising an upper flat having positive and negative contacts disposed thereon, the flat extended rearwards, a lower pin extended rearwards and parallel with the flat, and a peripheral engagement member including an annular ridge and a plurality of equally spaced latches along the ridge;

an illumination assembly comprising a forward sleevelike engagement member including a plurality of equally spaced axial, internal ribs each having a rear slot, a plurality of equally spaced indentations along a rear edge of the engagement member, and a plurality of L-shaped grooves; and an intermediate illumination member; and a hollow, cylindrical battery compartment comprising an axial, internal first wall having a circuit board mounted therein, two parallel axial, internal second walls, and a plurality of equally spaced keys along a forward edge thereof;

whereby mounting the illumination member in the engagement member, attaching the connecting assembly to the illumination assembly by bending the latches downwardly for allowing the ridge to engage with the slots, and attaching the coupled connecting assembly and the illumination assembly to the battery compartment by engaging the flat with a bottom of the first wall to electrically couple the illumination assembly to the battery compartment, inserting the pin insert into a gap between the second walls for positioning, engaging the keys with transverse portions of the grooves, and rotating the illumination assembly with respect to the battery compartment until the keys enter into vertical portions of the grooves will secure the illumination assembly, the connecting assembly, and the battery compartment together.

2. The flashlight of claim 1, wherein the illumination member comprises one or more LEDs.

3. The flashlight of claim 1, wherein the illumination assembly further comprises a rear holder for anchoring the illumination member.

4. The flashlight of claim 1, further comprising a forward hollow barrel put on the illumination assembly.

* * * * *